United States Patent [19]

Dwinell

[11] 4,163,512

[45] Aug. 7, 1979

[54] SINGLE USE POURING SPOUT AND COMBINATION

[75] Inventor: Davis B. Dwinell, Warren, N.J.

[73] Assignee: American Flange & Manufacturing Co. Inc., Linden, N.J.

[21] Appl. No.: 831,993

[22] Filed: Sep. 9, 1977

[51] Int. Cl.[2] ..... B65D 25/44

[52] U.S. Cl. ..... 222/525; 222/538; 222/541

[58] Field of Search ..... 222/541, 525, 532, 538, 222/81, 499, 522, 523, 537

[56] References Cited

U.S. PATENT DOCUMENTS

| | | | |
|---|---|---|---|
| 1,877,226 | 9/1932 | Chamberlain | 222/525 X |
| 3,063,604 | 11/1962 | Malpas | 222/541 X |
| 3,776,434 | 12/1973 | Christensen et al. | 222/525 |
| 3,804,305 | 4/1974 | Rieke | 222/538 |
| 4,128,192 | 12/1978 | Coryell | 222/525 |

FOREIGN PATENT DOCUMENTS

| | | | |
|---|---|---|---|
| 848093 | 7/1939 | France | 222/81 |

*Primary Examiner*—John P. Shannon

[57] ABSTRACT

A one piece pouring spout is inserted within a preformed can opening and fully seated for sealing against leakage and pilfering. In use, the spout is raised, to extended pouring position and rigidly retained within the can opening. The elongated tubular spout is integrally molded of synthetic plastic having its upper end closed off with a removeable sealing diaphragm and surrounded with a finger gripping ring. Upper and lower sealing surfaces are formed on the spout exterior to tightly engage the can opening in fully seated respective raised and lowered positions.

7 Claims, 9 Drawing Figures

SINGLE USE POURING SPOUT AND COMBINATION

BACKGROUND OF THE INVENTION

In the dispensing of liquid products from various types of cans and containers there is a need for a simplified plastic pouring spout which is stored within the can and subsequently raised to extended pouring position. Heretofore, those existing pull-up or retractable pouring spout arrangements have consisted of two or more separately molded parts. Generally speaking, these parts included a spout, a spout receiving nozzle and a closure member of some kind. While in many instances, two such parts where integrally molded, the end result has still imposed the burden of multiple molding and assembly operations.

These prior art pour spout constructions, although frequently quite well suited for their intended function, were purposely designed to accommodate a number of factors not always essential in the field of small single use containers. Such factors might include, for example, a tight reclosing feature or a suitably enlarged fill opening. The prior art closure field, however, appears to yield no response to the need for a simplified pull-up spout construction for small single use containers as embodied in the concept of the instant invention.

SUMMARY OF THE INVENTION

The invention solution herein disclosed consists of a tubular onepiece pouring spout integrally molded of synthetic plastic adapted for ready insertion within a metal, single use container. An effective liquid tight seal is formed upon full seating of the inserted spout in retracted position within the specially preformed container wall opening neck. To gain access to the sealed can in an authorized manner, an imperforate sealing diaphragm disposed at the uppermost end of the spout body is first punctured with a rigid implement. A convenient integrally molded pull member is then broken away from the upper end of the spout and employed to raise the spout up through the can opening whereupon the lower end portion of the spout body is rigidly retained by the opening neck in extended pouring position. Effective sealing and dispensing are thus quite readily achieved by means of the above described invention spout and in a manner which advantageously improves over the use of more costly and cumbersome multi-part prior art spout constructions.

It is accordingly a principal object of the invention to provide a new one-piece pull-up pouring spout molded of synthetic plastic and designed particularly for single use metal cans.

Another object is to provide a unitary tubular pouring spout adapted for insertion within a metal container wall openings so as to seal off that opening in fully seated position and be rigidly retained within the opening in extended pouring position.

A further object is to provide a one-piece plastic pull-up spout having a new and improved safety sealing diaphragm construction to facilitate tearing out of the diaphragm with the aid of a rigid puncturing implement but without need for cutting.

Other and more detailed objects will be in part pointed out and in part obvious as the description of the invention taken in conjunction with the accompanying drawing proceeds.

Figure 1:
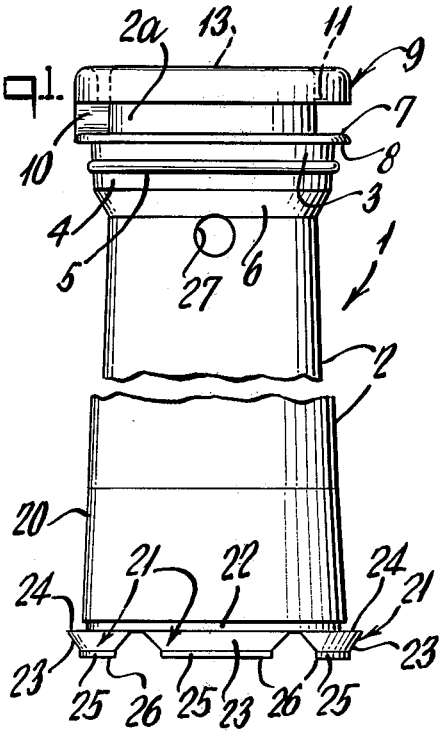
FIG. 1 is an elevational view partly broken away of the pouring spout in accordance with the invention.
Figure 2:
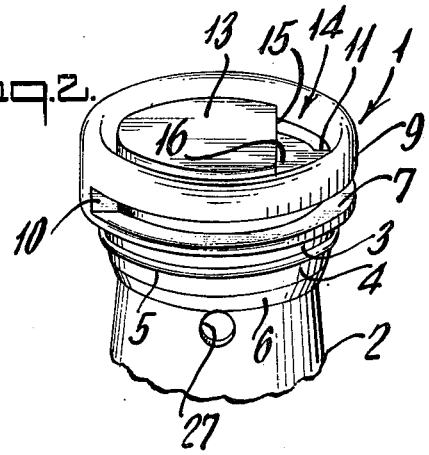
FIG. 2 is a perspective view of the upper end portion of the invention spout.

With particular reference to FIGS. 1 and 2 it can be seen that the spout 1, is integrally molded of synthetic plastic material such as low density polyethylene, as a non-limiting example, and consists of an elongated tubular body 2 having upper and lower end portions. The spout upper end portion is surrounded at an intermediate zone by a thickened wall section 3 having an exterior downwardly and radially inwardly tapered conical sealing surface 4. A circumferential locking bead 5, having a substantially hemispherical vertical cross sectional configuration, is formed on tapered surface 4. A further downwardly and radially inwardly tapered conical lead-in surface 6 extends from the sealing surface 4 to the intermediate exterior surface of the spout body 2. The uppermost end of the conical sealing surface 4 terminates at a circumferentially enlarged seating shoulder 7 which has a diameter which projects radially outwardly beyond the diameter of the locking bead 5 and is provided with a flat under surface 8 for engagement with a container wall surface as described hereinafter.

Figure 3:
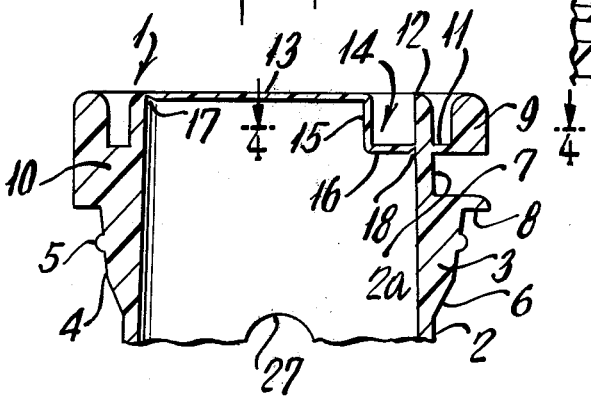
FIG. 3 is an enlarged vertical sectional view of the upper end of the spout.

The spout body 2 extends vertically above the shoulder 7 as indicated at 2*a* and is surrounded by a circular ring pull member 9. As seen in FIG. 3 the ring pull 9 forms a complete annulus overlying the shoulder 7 and spaced thereabove. A connecting web 10 integrally formed to the upper surface of shoulder 7 joins the ring pull 9 to the spout body 2. The ring pull 9 has an internal diameter larger than the external diameter of the upper spout body portion 2*a*. In order to retain the ring pull 9 in a stored position in concentric alignment with the body portion 2*a* it is interconnected thereto by one or more frangible links 11 which act as pilfer indicating means. Thus by grasping the ring pull 9 opposite the web 10 the links 11 are easily broken and the ring pull becomes accessible for pulling the spout 2 upwardly into pouring position.

Figure 4:
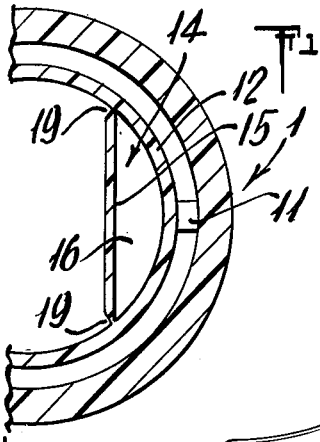
FIG. 4 is a fragmentary sectional view taken along line 4—4 in FIG. 3 and looking in the direction of the arrows.

The uppermost end 12 of the spout body portion 2*a* is substantially coplanar with the upper surface of the ring pull 9 and is closed off with an integrally molded, imperforate sealing diaphragm 13. As further shown in FIG. 4, a puncturing guide or pocket 14 is formed in the sealing diaphragm defined by a chordally extending vertical wall 15 and a flat bottom wall 16 the outer edge of which is integrally formed with the interior surface of the spout body portion 2*a*. The outer edges of the vertical walls 15 are also integrally formed with the interior surface of the spout body portion 2*a*. To further assist in readying the spout for pouring, the entire sealing diaphragm 13, including the well or pocket 14, is surrounded by a weakened tearing zone. This tearing zone consists of a major partial circular section 17 which connects the sealing diaphragm 13 to the uppermost end of the spout and a minor partial circular section 18 connecting the outer edge of the pocket bottom wall 16 to the interior surface of the spout body portion 2*a*. In addition a pair of vertical tearing zone sections 19, formed at the outer edges of the chordal wall 15, are joined with the upper major zone 17 and the lower minor zone 18 resulting in a continuous uninterrupted weakening of the entire closed end of the spout.

Figure 5:
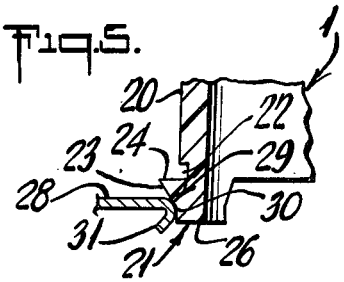
FIG. 5 is an enlarged fragmentary sectional view showing the spout positioned on the container wall opening prior to insertion.

Considering next the lower portion of the spout body, in FIG. 1 it is seen how the spout body 2 tapers radially outwardly at a slight angle creating an elongated conical surface 20 adjacent the lowermost end of the spout. The spout lower portion terminates in a series of individual circumferentially spaced locking feet 21, four being shown for purposes of illustration. Each of the feet 21, as seen in FIGS. 1 and 5, extend a slight distance axially from the lowermost end of the spout and are separated from the conical surface 20 by a narrow, radially outwardly opening circumferential groove 22. A radially inwardly and downwardly extending conical camming surface 23 is formed on the outer surface of each locking foot 21 and is joined to the base of the groove 22 by an upwardly facing locking surface 24. The lowermost extremity of each camming surface 23 terminates in a short axially extending pilot portion with the feet terminating in spout end surfaces 26.

The upper portion of the spout body is provided with a vent aperture 27 formed in the spout wall immediately beneath the lead-in surface 6. Other than the aperture 27, the interior surface of the spout remains smooth and continuous free of any internal projections which would impede fluid flow and seriously complicate efficient molding operations.

The container with which the above described spout is used is normally a light weight, single use metal can as a nonlimiting example. The top wall of such a can is illustrated in the drawing indicated at numeral 28, and is formed with an opening surrounded by a downwardly curled neck 29. The illustrated opening neck configuration has a sharply radiused vertical cross-section so as to present an internal diameter contact surface 30. The neck 29 then extends downwardly and radially outwardly just beyond the contact surface 30 and terminating at the free edge 31.

The initial assembly of the spout to the can is most commonly carried out as the last step in the can filling process, that is to say, after the can has been filled through the open top end and the can lid with its preformed spout opening seamed in place. To effect this assembly, the spout 1 is placed over the container wall opening with the pilot portions 25 extending within the opening neck 29 thus correctly aligning the spout for insertion, as illustrated in FIG. 5. An axially directed force on the upper end of the spout forces the camming surfaces 23 past the neck contact surface 30 causing radial inward flexing of the locking feet 21. Insertion of the spout within the can opening is completed with the application of a further axially directed force wherein the spout lead-in surface 6 guides the tapered sealing surface 4 inside the opening neck 29. The rounded surface of the locking bead 5 is then forced past the opening neck contact surface 30 whereupon full seating of the spout is effected. Here it can be seen, with particular reference to FIG. 7, that the opening neck contact surface 30 tightly engages the spout sealing surface 4. In addition, the spout shoulder undersurface 8 tightly bears against the container end wall 28 with the lower portion of the curled neck resting on the upper surface of the locking bead 5. It is important to note, however, that the neck free edge 31 extends radially outwardly of the bead 5 so as to remain out of contact therewith. The resulting engagement of the spout with the container wall provides an effective liquid tight seal under widely varying packaging, shipping and handling conditions. Moreover, the rigidity and efficiency of the above described closing effect is accomplished with a simple unitary self-supporting spout construction as described without reliance on additional plugs, caps or nozzles.

Figure 7:
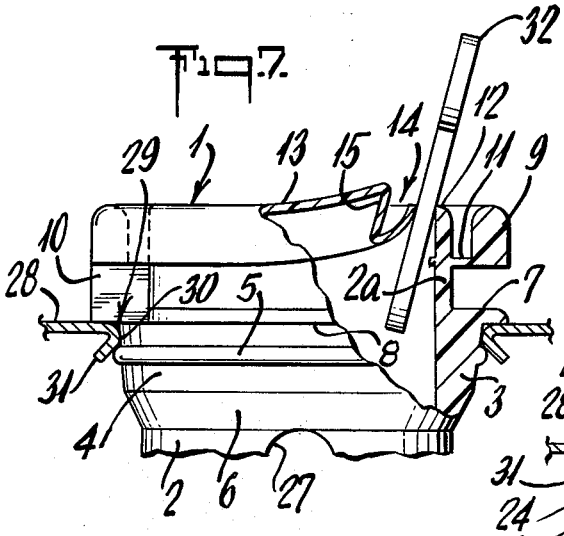
FIG. 7 is a view similar to FIG. 3 showing the sealing diaphragm being punctured for removal.

To gain access to the container, the imperforate tamper proof sealing diaphragm 13 is easily torn away by simply inserting a rigid implement, such as an automobile ignition key, as indicated at numeral 32 in FIG. 7, into the small well or pocket 14 and exerting a puncturing force against the bottom wall 16. The sealing diaphragm easily ruptures along the tearing zone portion 18 allowing the key 32 to pass easily therethrough. The key then serves as a lever, using the spout end 12 for a fulcrum, to pry up the rest of the diaphragm which can then be grasped and readily torn away. The degree of ease with which the above described puncturing and tearing steps are carried out fully meet the convenience requirements of present day packaging, and yet, is such as to advantageously thwart the opening attempts of young children.

Figure 6:
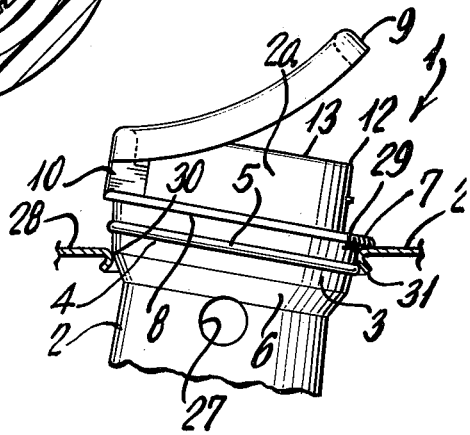
FIG. 6 is a part sectional part elevational view of the spout being inserted within the container wall opening.
Figure 8:
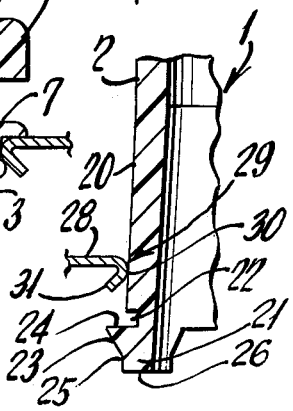
FIG. 8 is a view similar to FIG. 5 showing the spout in an intermediate extended pouring position.
Figure 9:
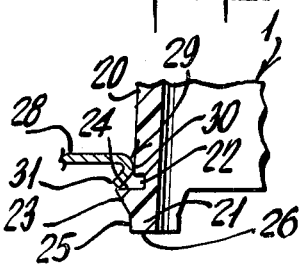
FIG. 9 is a further view similar to FIG. 5 showing the spout in full extended pouring position.

To ready the container for pouring, the ring pull 9 is torn upwardly breaking the frangible link 11 which acts as a further safeguard against tampering. As seen in FIG. 6, continued upward pulling on the ring snaps the bead 5 past the opening neck contact surface 30 and free of the metal edge 31 to avoid digging into the plastic. The spout is then pulled up through the can opening until the opening neck contact surface 30 tightly wedges against the conical surface 20. Due to the plastic swelling effect frequently encountered with chemically active products commonly dispensed from single use cans, the intermediate spout extension as seen in FIG. 8, is in many instances quite adequate to rigidly support the spout for pouring. However, as seen in FIG. 9, in those packaging applications where swelling is not a factor or where excessive pulling force is applied, the spout can be fully extended until the locking surface 24 on the spout locking feet 21 engage the opening neck 29. Here it can be seen that the neck free edge 31 bites into the locking surface 24 for maximum resistance to withdrawal of the spout from the can opening and the neck contact surface 30 is positioned in sealing engagement with the spout surface 20 above the groove 22. With the spout thus rigidly held in either the intermediate or fully extended pouring positions, controlled dispensing of the container contents into relatively inaccessible receptacle openings is greatly assisted.

Variations in the spout construction could well be employed, one example of which would be to eliminate the tearing zones from the closed end of the spout and enlarge the vent opening to enable lateral instead of axial pouring. Also, the spout locking bead might extend helically to effect a thread engagement with the opening neck should rotational movement be preferred to the snap-out action.

Further changes in or modifications of the spout construction and different embodiments of the invention could suggest themselves to those skilled in the art and could be made without departing from the spirit or scope of the invention. It is, accordingly, intended that all matter contained in the above description or shown in the accompanying drawing shall be interpreted as being illustrative and not in a limiting sense.

I claim:

1. A one-piece pull-up pouring spout integrally molded of synthetic plastic material for displacement between a lowered container sealing position and raised pouring position comprising an elongated tubular body having a smooth interior surface free of internal projections, said spout having a closed upper end portion and an open lower end portion, a first selfsupported sealing surface disposed about the upper end portion of said spout tubular body dimensioned for tight sealing engagement within a container wall opening with said spout in lowered sealing position whereby said one-piece spout acts as the sole means for closing off the container wall opening, a second sealing surface disposed about the lower end portion of said spout for sealing engagement within a container wall opening with said spout in raised pouring position, and gripping means integrally connected to said spout for pulling said spout from said lowered sealing engagement and raising said spout from a lowered container sealing position to an extended position.

2. A one-piece pull-up pouring spout integrally molded of synthetic plastic material for displacement between a lowered container sealing position and a raised pouring position comprising an elongated tubular body having a smooth interior surface free of internal projections, said spout having a closed upper end portion and an open lower end portion, a first self-supported sealing surface disposed about the upper end portion of said spout dimensioned for tight sealing engagement within a container wall opening with said spout in lowered sealing position whereby said one-piece spout acts as the sole means for closing off the container wall opening, a second sealing surface disposed about the lower end portion of said spout for sealing engagement within a container wall opening with said spout in raised pouring position, gripping means integrally connected to said spout for raising said spout from a lowered container sealing position to an extended position and pilfer indicating means interconnecting said gripping means and said spout body.

3. A pull-up pouring spout as in claim 1 including a severable zone at the upper end portion of said spout.

4. A pull-up pouring spout as in claim 3 wherein said gripping means is connected to said spout at a position vertically below said severable zone.

5. A pull-up pouring spout as in claim 3 and means formed within said severable zone for reception of a puncturing implement.

6. In combination, a container having a spout receiving opening therein surrounded by a supporting neck, a one-piece pull-up pouring spout integrally molded of synthetic plastic material for displacement between a lowered container sealing position and raised pouring position comprising an elongated tubular body having a closed upper end portion and an open lower end portion, a first self-supported sealing surface disposed about the upper end portion of said spout tubular body dimensioned for tight sealing engagement within said container wall opening neck with said spout in lowered sealing position whereby said spout acts as the sole means for closing off said opening, a second sealing surface disposed about the lower end portion of said spout for sealing engagement within said container wall opening neck with said spout in raised pouring position, and gripping means integrally connected to said spout for pulling said spout from said lowered sealing engagement and raising said spout from a lowered container sealing position to an extended pouring position.

7. A combination as in claim 6 wherein said supporting neck has a sharply radiused surface in contact with said spout.

* * * * *